US005379613A

United States Patent [19]

Suzuki

[11] Patent Number: 5,379,613

[45] Date of Patent: Jan. 10, 1995

[54] METHOD OF FINISHING EDGES OF KNITTED FABRIC

[75] Inventor: Masato Suzuki, Wakayama, Japan

[73] Assignee: Shima Seiki Mfg., Ltd., Wakayama, Japan

[21] Appl. No.: 91,740

[22] Filed: Jul. 14, 1993

Related U.S. Application Data

[63] Continuation of Ser. No. 785,595, Oct. 30, 1991, abandoned.

[30] Foreign Application Priority Data

Oct. 31, 1990 [JP] Japan ..... 2-296756

[51] Int. Cl.[6] ..... D04D 7/10

[52] U.S. Cl. ..... 66/69; 66/70; 66/76; 66/172 R

[58] Field of Search ..... 66/169 R, 169 A, 170, 66/171, 174, 175, 176, 177, 178 R, 178 A, 179, 180, 173, 172 R, 172 E, 67, 70, 71, 76, 87, 200, 69

[56] References Cited

U.S. PATENT DOCUMENTS

| | | | |
|---|---|---|---|
| 463,561 | 10/1891 | Wilcomb | 66/181 |
| 2,283,585 | 5/1942 | Smith | 66/172 E |
| 2,847,838 | 8/1958 | Minton | 66/200 |
| 2,854,832 | 10/1958 | Morris | 66/200 |
| 3,224,231 | 12/1965 | Matz | 66/171 |
| 4,548,057 | 10/1985 | Essig | 66/69 X |

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

A method of finishing the edges of a knitted fabric which makes use of a flat knitting machine which has at least a pair of front and rear needle beds, one bed or both being arranged for lengthwise movement, transferring edge loops of the knitted fabric hooked on their respective knitting needles from one needle bed to the other; knitting a strand of stitches from a given number of the loops carried on the knitting needles of the needle bed at one side; transferring the front end loops of the strand onto desired knitting needles of the opposite needle bed; moving the needle beds relative to each other for displacing the front end loops of the strand from the start position of the same; placing the front end loops of the strand over given edge loops of the knitted fabric for coupling; and repeating the foregoing steps from transferring the edge loops of the knitted fabric to placing the front end loops of the strand over given edge loops of the knitted fabric.

3 Claims, 13 Drawing Sheets

Fig. 2—1
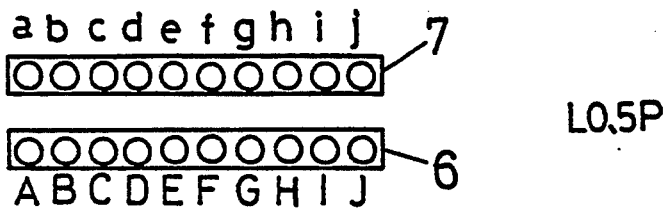
Fig. 2—2
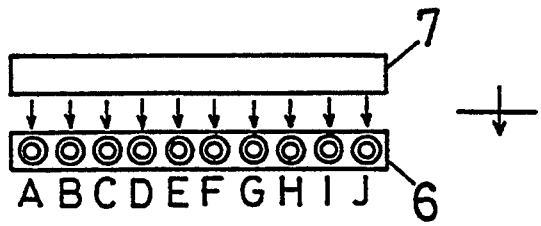
Fig. 2—3
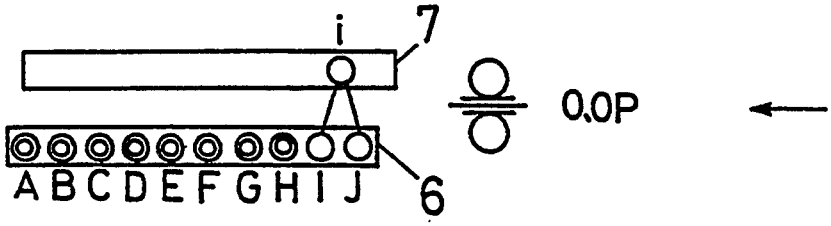
Fig. 2—4
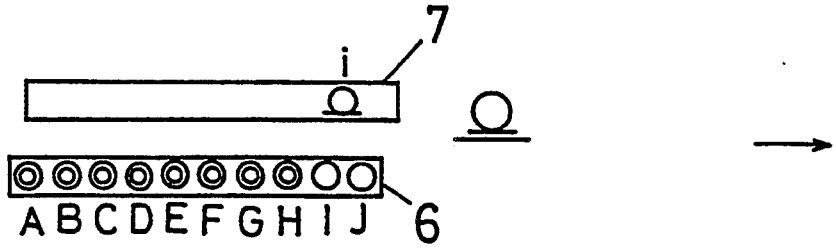

R1.5P

Fig. 2—37
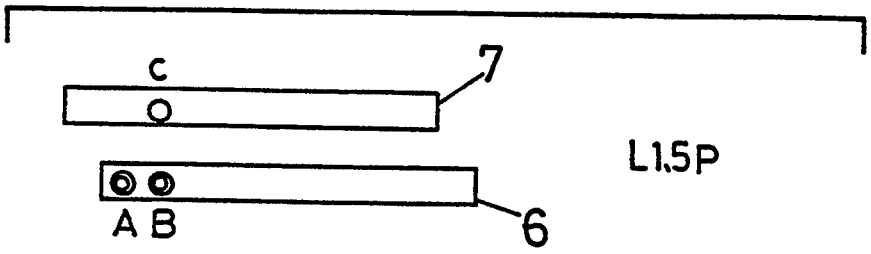
Fig.2—38
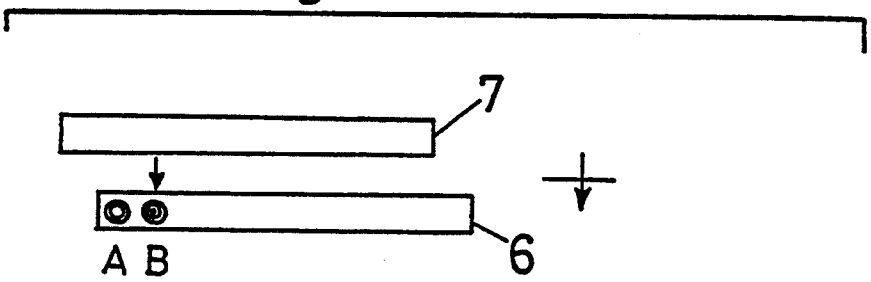
Fig. 2—39
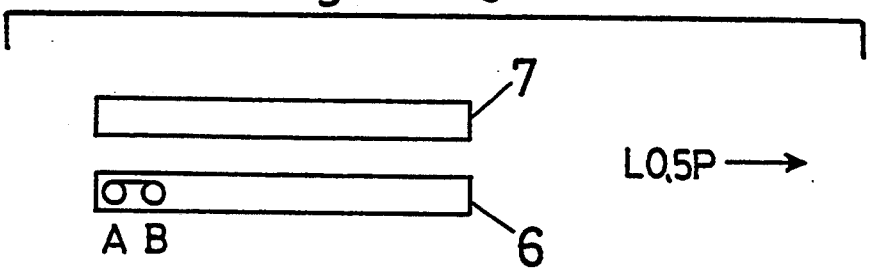
Fig.3— 1
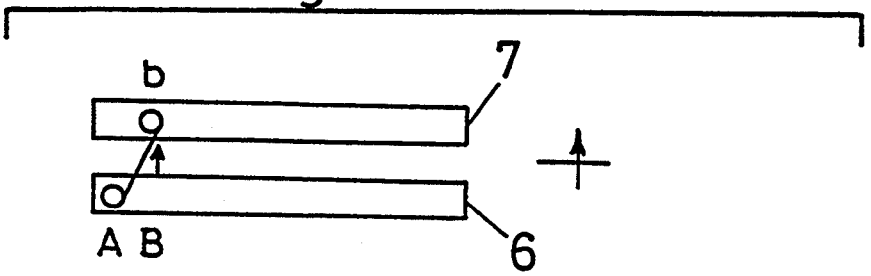

Fig. 3—2
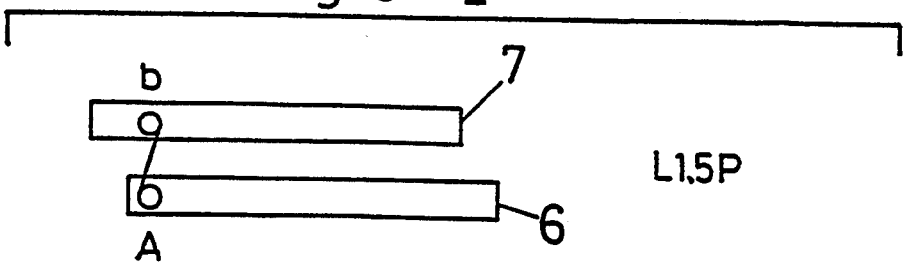
Fig.3—3
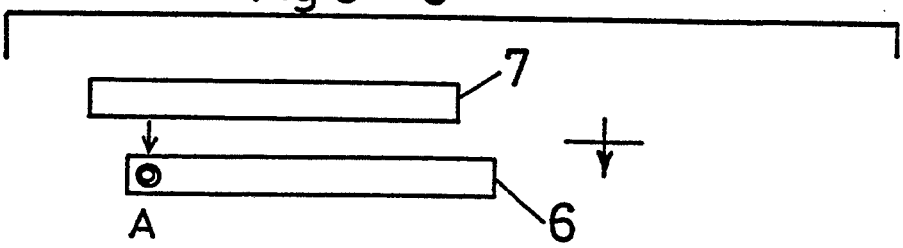
Fig.3—4
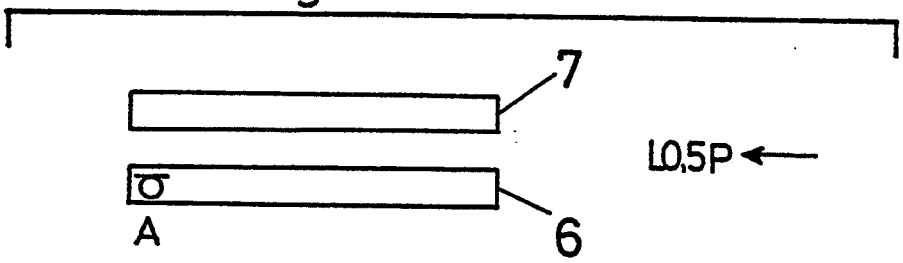
Fig.3—5
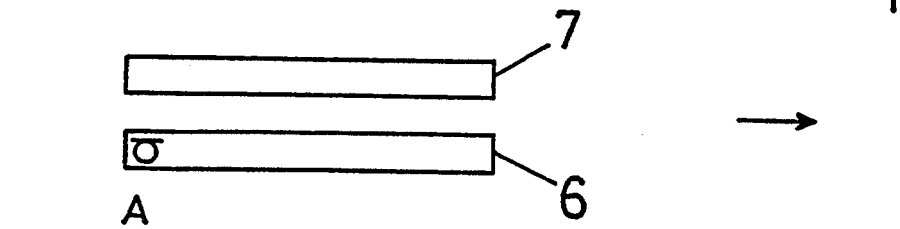

Fig.4-A
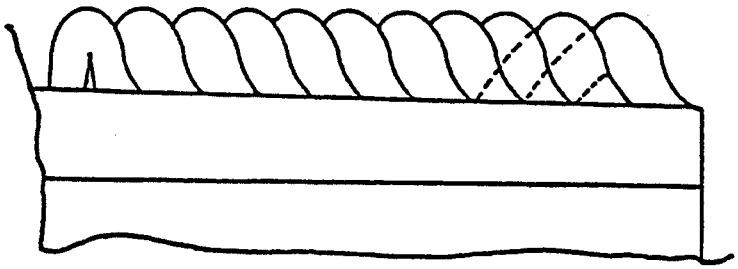
Fig.4-B
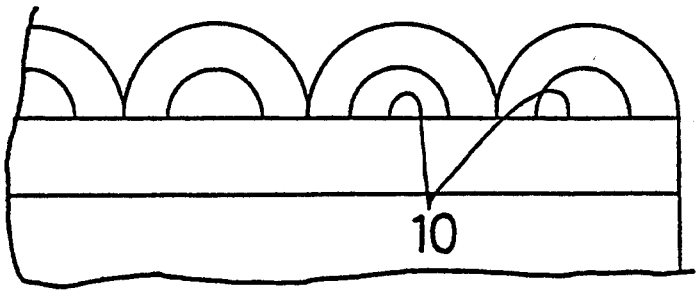
Fig.4-C
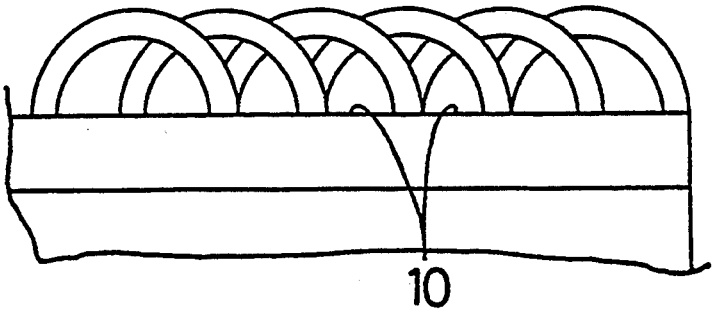
Fig.4-D
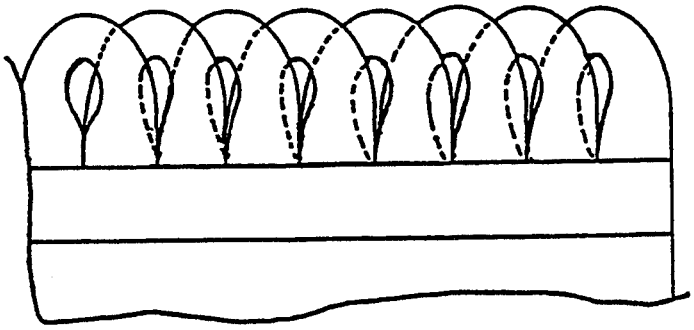

METHOD OF FINISHING EDGES OF KNITTED FABRIC

This is a continuation of copending application(s) Ser. No. 07/785,595 filed on Oct. 30, 1991, now abandoned.

BACKGROUND OF THE INVENTION

The present invention relates to a method of finishing the edges of a knitted fabric, e.g. a neck or cuff portion of a pullover garment with a decorative pattern and also, a knitted fabric provided at an edge with a decorative finish.

In common, the edges of a neck or cuff portion of a pullover garment are bound off along their edge loops. For providing a desired decorative finish, a separately knitted piece of the decorative pattern is sewed with a sewing machine or added using e.g a linking technique to the bound off region of the pullover garment.

However, joining of a decorative pattern to the edges of a knitted fabric by such a linking technique involves stitch-by-stitch weaving of a strand form of stitches, e.g. a series of consecutive arch patterns along the seam. This action requires a considerable length of time and a specific skill, thus decreasing the productivity.

Also, dropping of a stitch is unavoidable in such stitch-by-stitch joining of loops between the strand of the decorative pattern and the edge of the bound off portion.

When the two pieces are sewed together with a sewing machine for forming a tubular shape, they overlap each other thus causing the seam in between to become greater in the thickness and appear less attractive. Also, a finished garment will provide less comfortability in use.

Above all, the sewing or linking of the decorative piece has to be carried out by an extra procedure other than the primary procedure of knitting the main piece. Hence, the overall cost of production will be increased by the extra procedure.

The present invention is intended to overcome the foregoing drawbacks and its object is to provide a method of finishing the edges of a knitted fabric by knitting a series of arch strands in succession onto the edge of the knitted fabric and also, a knitted fabric provided at an edge with a series of arch strands of a decorative pattern.

SUMMARY OF THE INVENTION

For achievement of the foregoing object, a method of finishing the edges of a knitted fabric according to the present invention comprises the steps of: with the use of a flat knitting machine which has at least one front and one rear needle beds, one bed or both being arranged for lengthwise movement or a racking procedure, transferring edge loops of the knitted fabric hooked on their respective knitting needles from one needle bed to the other; knitting a strand of stitches from a given number of the loops carried on the knitting needles of the needle bed at one side; transferring the front end loops of the strand onto desired knitting needles of the opposite needle bed; moving the needle beds relative to each other for displacing the front end loops of the strand from the start position of the same; placing the front end loops of the strand over given edge loops of the knitted fabric for coupling; and repeating the foregoing steps from transferring the edge loops of the knitted fabric to placing the front end loops of the strand over given edge loops of the knitted fabric. In particular, the front end loops of the strand during transferring back from one needle bed to the other needle bed are placed over given edge loops of the knitted fabric after they have been displaced by more than a length of the stitches of the strand from the start position and then, another strand of stitches is started from an intermediate of the displacement, as followed by repeating a procedure from casting on of a strand to displacing the front end loops of the strand from its start position to another position and placing them over given edge loops of the knitted fabric. Also, the present invention is directed towards a knitted fabric provided at an edge with a decorative finish using a flat knitting machine which has at least one front and one rear needle bed, one bed or both being arranged for lengthwise movement, characterized in which a series of arch-shaped strands are knitted for the purpose of decoration in succession to the edge of the knitted fabric through forming a strand form of stitches from one end of the bound-off edge of the knitted fabric and joining its front end to another part of the edge of the knitted fabric.

In action, the procedure starts with knitting a front and/or a back piece of a pullover garment using a flat knitting machine which has at least two, front and rear, needle beds, either one or both being arranged for lengthwise movement.

When the end or neck region of the front and/or back piece is completed, edge loops of the piece all are transferred from one needle bed to the other.

Then, a strand of stitches is knitted to a predetermined length from a given number of the loops at one end of the other needle bed.

When the strand of stitches of the length is completed, its front end loops are transferred back to desired knitting needles of the first needle bed. The needle beds are then moved relative to each other and the front end loops of the strand are displaced from its start position to a target position on the needle bed.

The front end loops of the strand are placed over given edge loops of the knitted fabric for coupling. As the result, an arch form of stitches Is produced at one end of the edge of the knitted fabric.

Through repeating the foregoing procedure from casting on a strand of stitches to knitting it into an arch form, a series of arch strands of stitches are formed along the edge of the knitted fabric.

During the procedure from casting on a strand of stitches to binding off for forming an arch, the front end loops of the strand are disk, laced by more than a length of the stitches of the strand from the start position prior to being transferred back from the opposite needle bed. After the front end loops of the strand is placed over given edge loops of the knitted fabric for coupling thus to produce an arch form, another strand of stitches is started from an intermediate of the displacement. This action is repeated so that a series of partially overlapped arch strands are neatly formed along the edge of the knitted fabric exhibiting a considerable degree of richness.

BRIEF DESCRIPTION OF THE DRAWINGS

The accompanying drawings illustrate one preferred embodiment of the present invention in the form of a method of joining two tubular knitted fabrics and two tubular knitted fabrics joined with their edges by knitting, in which

FIGS. 2-1 to 2-39 are explanatory views showing a procedure of knitting a decorative pattern of strand shape; FIGS. 3-1 to 3-5 are explanatory views showing a procedure of binding off the edge loops of the decorative pattern; and FIGS. 4-A, 4-B, 4-C, and 4-D are front views of different decorative patterns.

DETAILED DESCRIPTION OF THE INVENTION

One preferred embodiment of the present invention will be described referring to the accompanying drawings.

Figure 1:
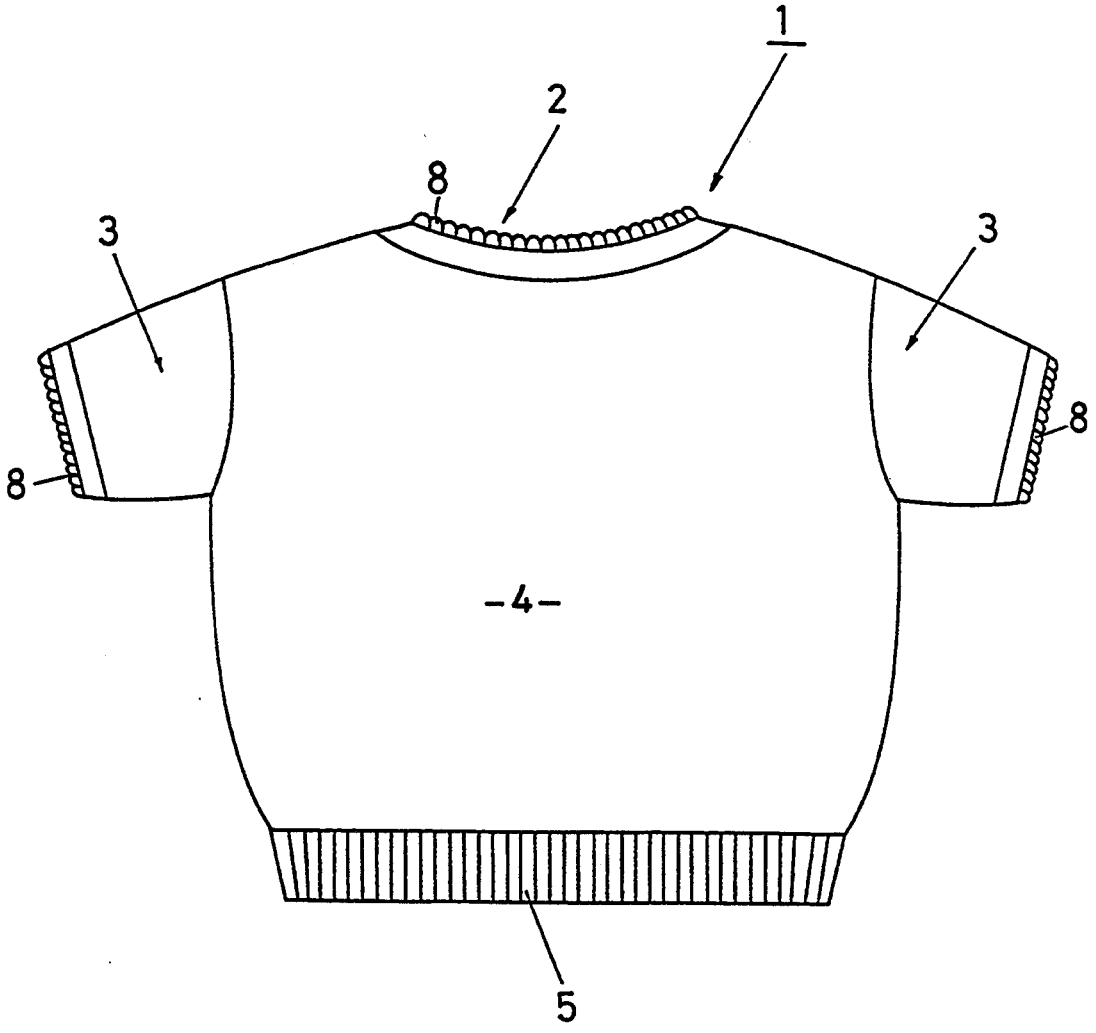
FIG. 1 is a front view of a pullover garment knitted by the method of the present invention.

A method of finishing the edges of a knitted fabric with decorative stitches according to the present invention is employed for knitting the edges of a neck portion 2 or cuff portion 3 of a pullover garment 1, as shown in FIG. 1. In common, such a method is executed using a flat knitting machine which has one, front and one rear movable needle beds provided in the inverted-V shape arrangement when viewed from one side, each bed carrying a multiplicity of knitting needles mounted on the top thereof for forward and backward movement.

The knitting procedure of a body piece (knitted fabric) 4 of the pullover garment 1 shown in FIG. 1 starts with its waist region 5 and finishes with the neck portion 2.

FIGS. 2-1 to 2-39 illustrate a series of primary courses for knitting a decorative pattern of the neck portion 2, in which the alphabetic capital letters A, B, C, D, ... represent knitting needles of the front needle bed 6, the alphabetic small case letters a, b, c, d, ... are knitting needles of the rear needle bed 7, the two rightward letters L and R denote the moving directions of the needle beds, and the numeral associated with the letters P and L or R denotes the distance of movement.

Figures 2, 3, 4, 5:
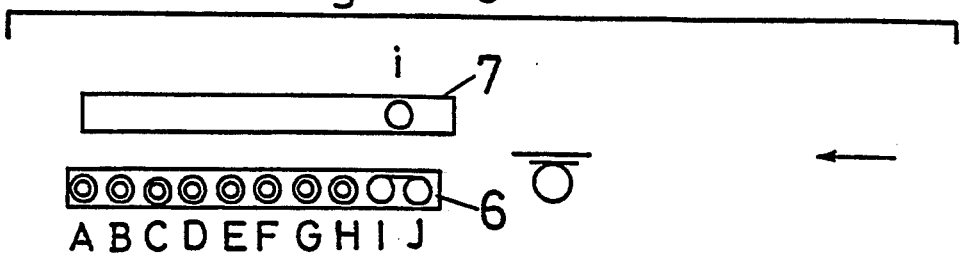
Figures 2, 3, 4, 5, 6:
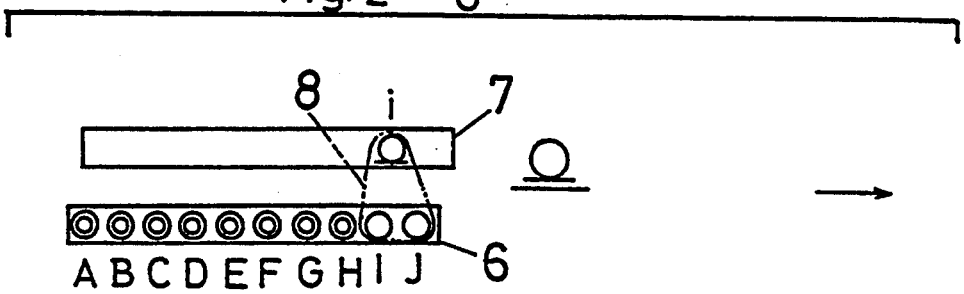
Figures 2, 3, 4, 5, 6, 7:
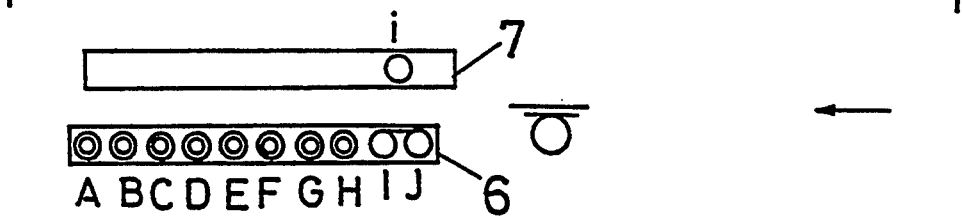
Figures 2, 3, 4, 5, 6, 7, 8:
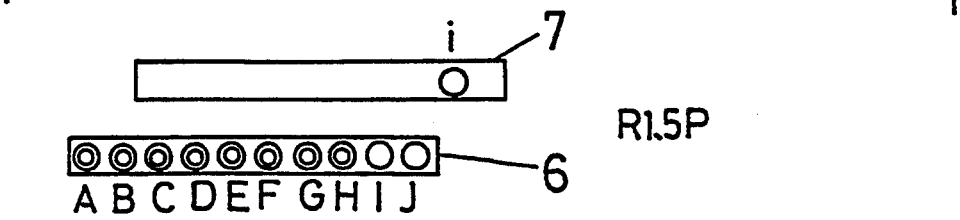
Figures 2, 3, 4, 5, 6, 7, 8, 9:
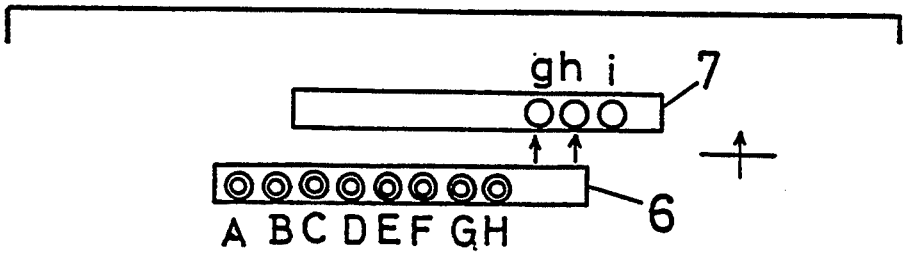
Figures 2, 3, 4, 5, 6, 7, 8, 9, 10:
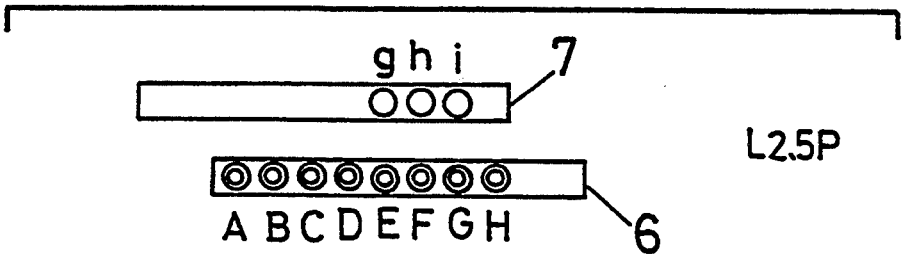
Figures 2, 3, 4, 5, 6, 7, 8, 9, 10, 11:
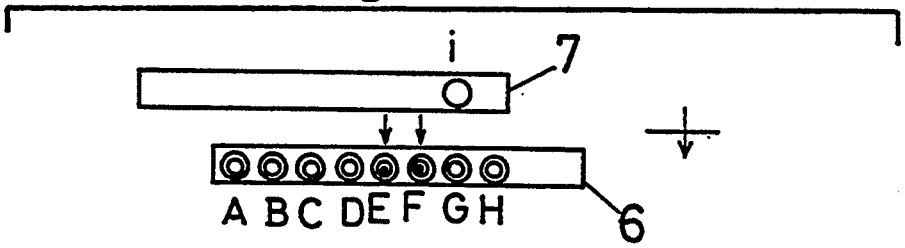
Figures 2, 3, 4, 5, 6, 7, 8, 9, 10, 11, 12:
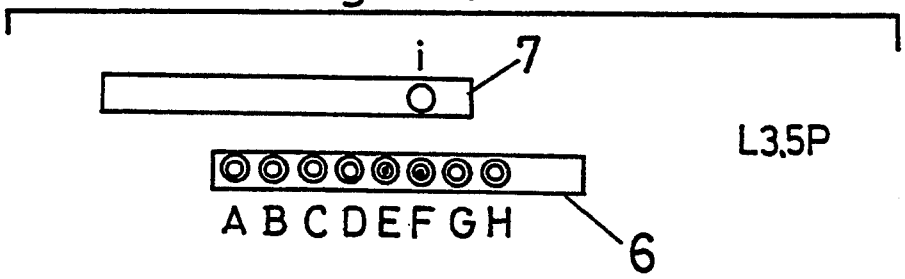
Figures 2, 3, 4, 5, 6, 7, 8, 9, 10, 11, 12, 13:
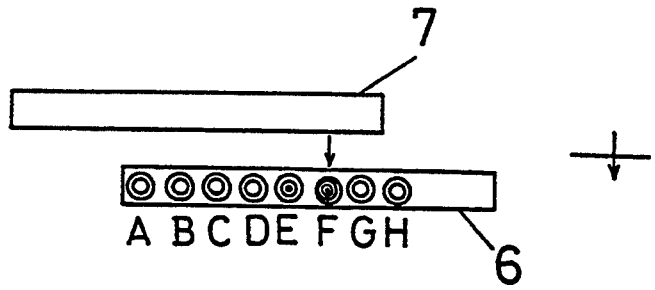
Figures 2, 3, 4, 5, 6, 7, 8, 9, 10, 11, 12, 13, 14:
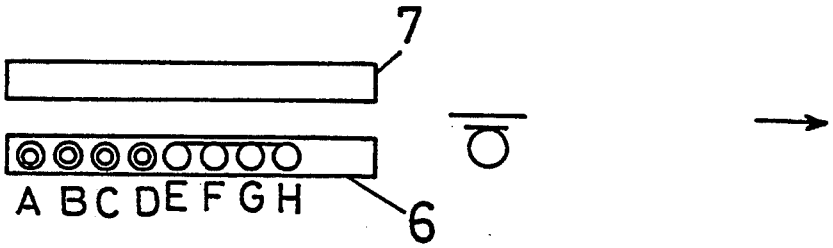
Figures 2, 3, 4, 5, 6, 7, 8, 9, 10, 11, 12, 13, 14, 15:
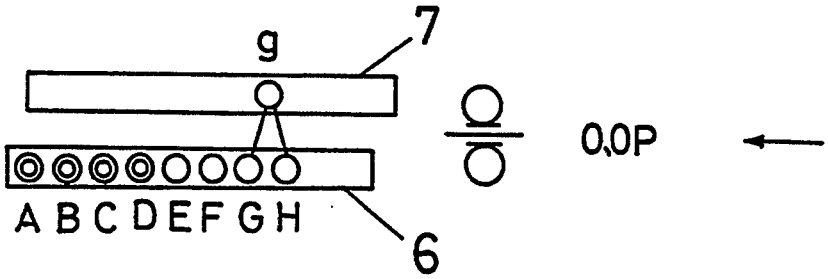
Figures 2, 3, 4, 5, 6, 7, 8, 9, 10, 11, 12, 13, 14, 15, 16:
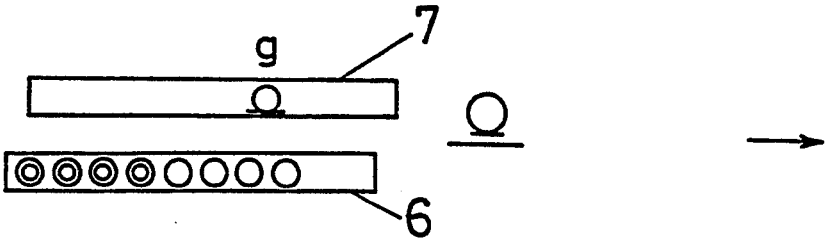
Figures 2, 3, 4, 5, 6, 7, 8, 9, 10, 11, 12, 13, 14, 15, 16, 17:
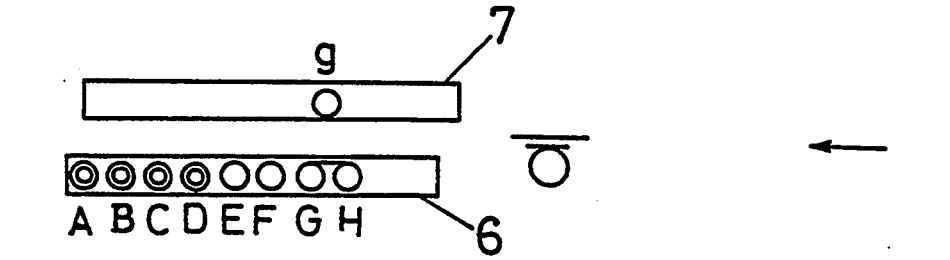
Figures 2, 3, 4, 5, 6, 7, 8, 9, 10, 11, 12, 13, 14, 15, 16, 17, 18:
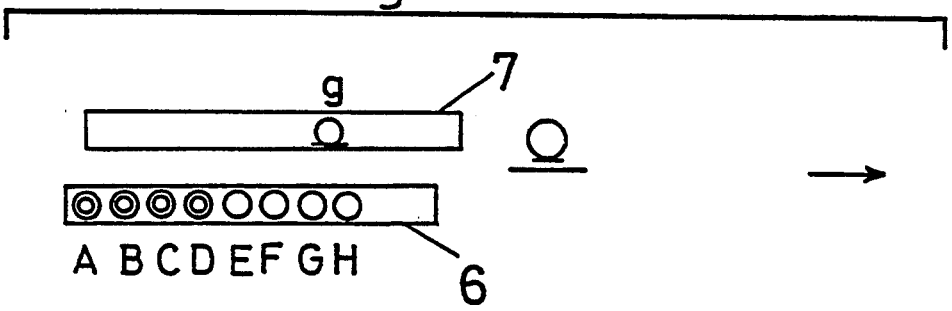
Figures 2, 3, 4, 5, 6, 7, 8, 9, 10, 11, 12, 13, 14, 15, 16, 17, 18, 19:
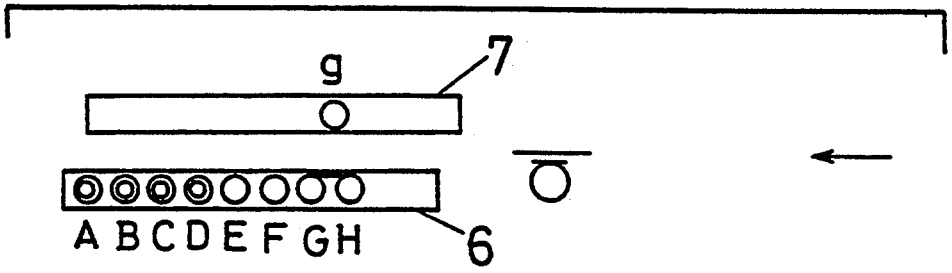
Figures 2, 3, 4, 5, 6, 7, 8, 9, 10, 11, 12, 13, 14, 15, 16, 17, 18, 19, 20:
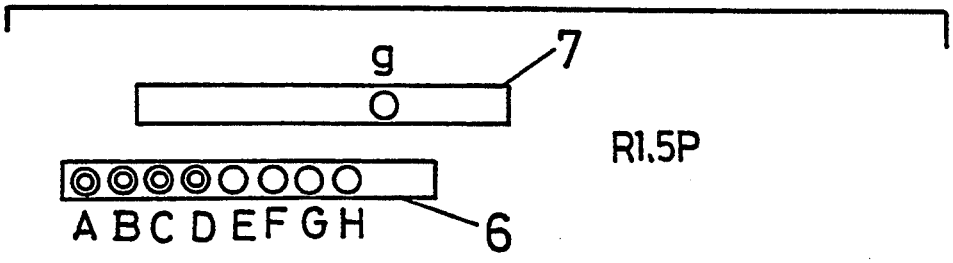
Figures 2, 3, 4, 5, 6, 7, 8, 9, 10, 11, 12, 13, 14, 15, 16, 17, 18, 19, 20, 21:
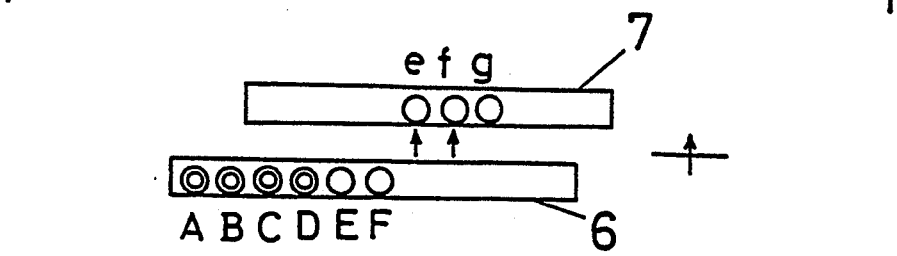
Figures 2, 3, 4, 5, 6, 7, 8, 9, 10, 11, 12, 13, 14, 15, 16, 17, 18, 19, 20, 21, 22:
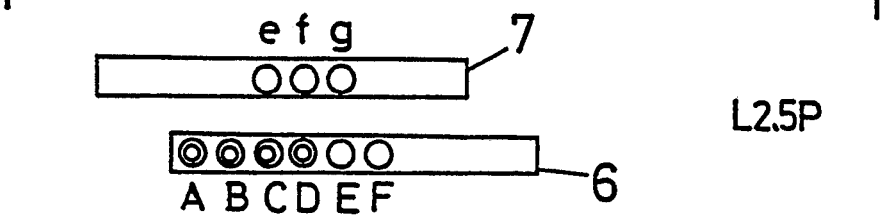
Figures 2, 3, 4, 5, 6, 7, 8, 9, 10, 11, 12, 13, 14, 15, 16, 17, 18, 19, 20, 21, 22, 23:
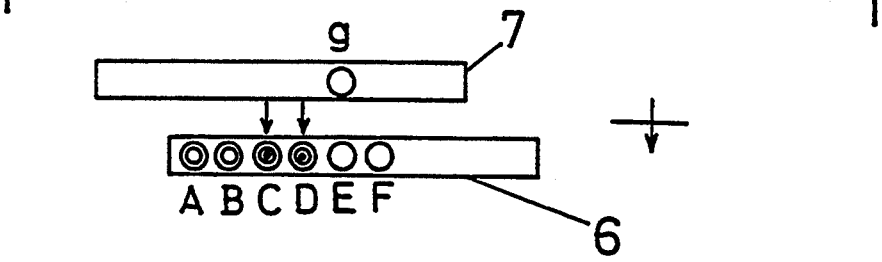
Figures 2, 3, 4, 5, 6, 7, 8, 9, 10, 11, 12, 13, 14, 15, 16, 17, 18, 19, 20, 21, 22, 23, 24:
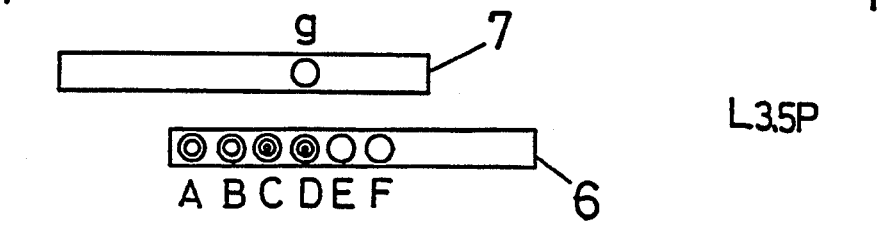
Figures 2, 3, 4, 5, 6, 7, 8, 9, 10, 11, 12, 13, 14, 15, 16, 17, 18, 19, 20, 21, 22, 23, 24, 25:
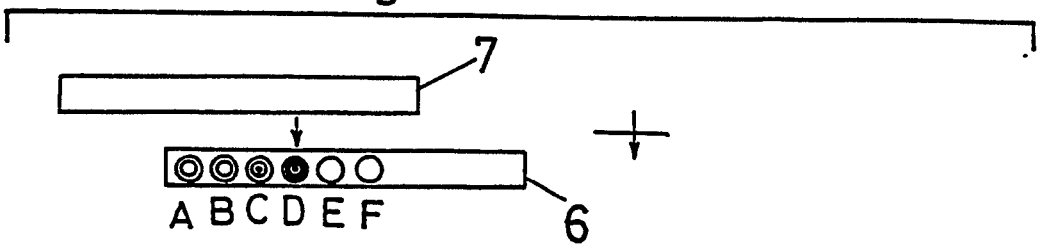
Figures 2, 3, 4, 5, 6, 7, 8, 9, 10, 11, 12, 13, 14, 15, 16, 17, 18, 19, 20, 21, 22, 23, 24, 25, 26:
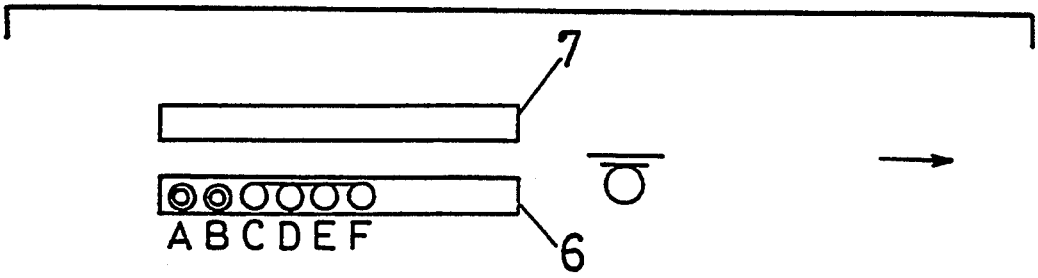
Figures 2, 3, 4, 5, 6, 7, 8, 9, 10, 11, 12, 13, 14, 15, 16, 17, 18, 19, 20, 21, 22, 23, 24, 25, 26, 27:
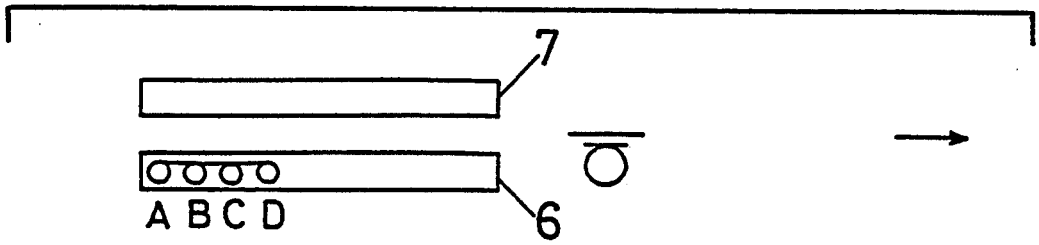
Figures 2, 3, 4, 5, 6, 7, 8, 9, 10, 11, 12, 13, 14, 15, 16, 17, 18, 19, 20, 21, 22, 23, 24, 25, 26, 27, 28:
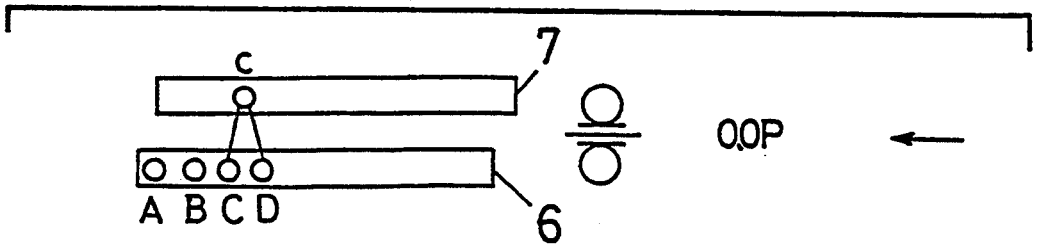
Figures 2, 3, 4, 5, 6, 7, 8, 9, 10, 11, 12, 13, 14, 15, 16, 17, 18, 19, 20, 21, 22, 23, 24, 25, 26, 27, 28, 29:
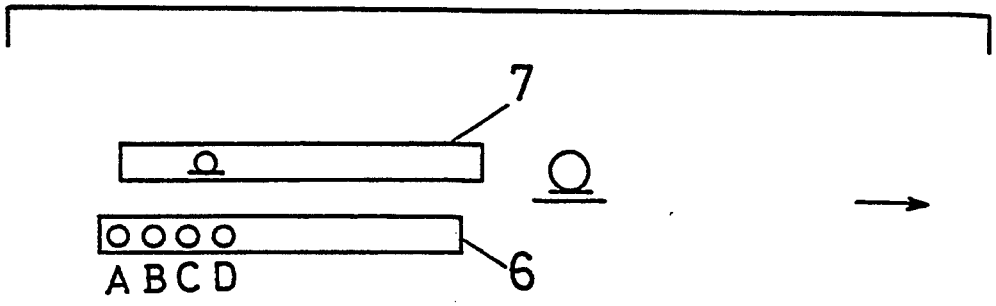
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30:
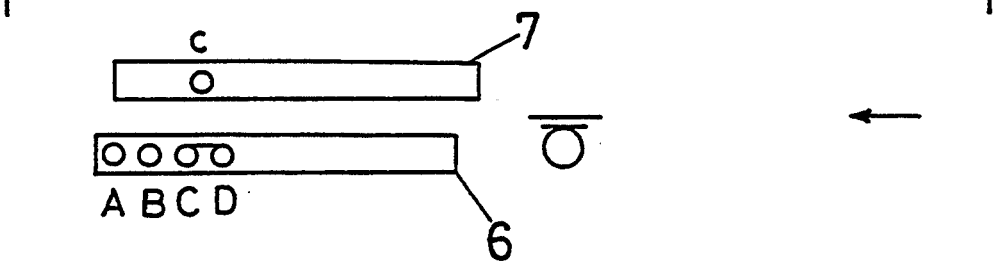
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31:
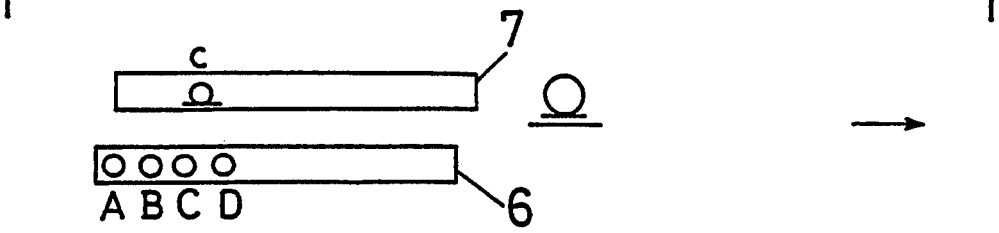
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32:
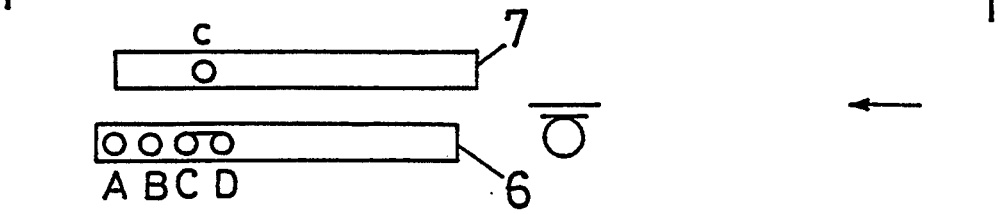
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33:
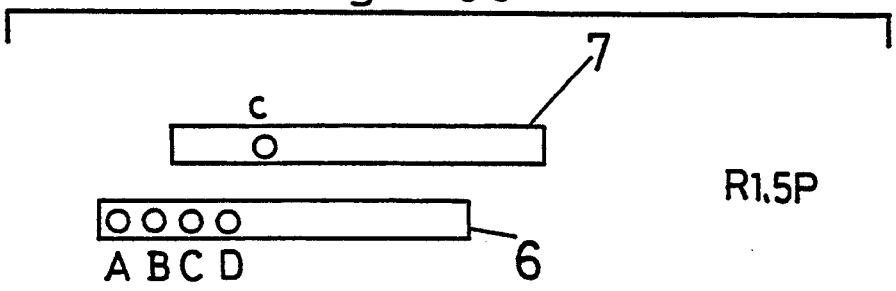
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34:
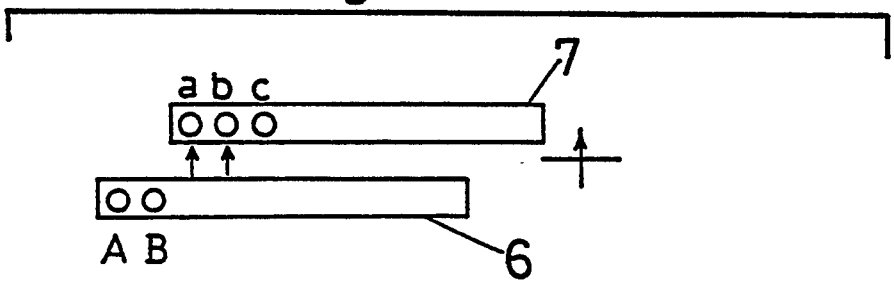
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35:
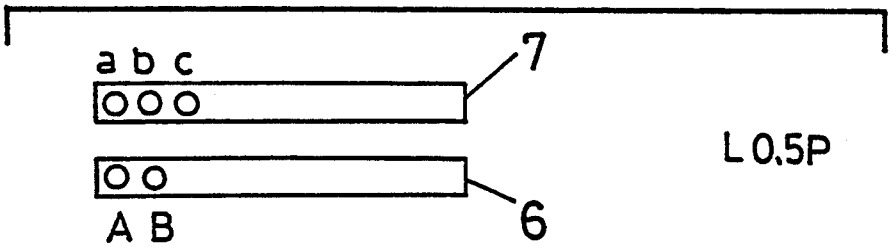
Figures 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36:
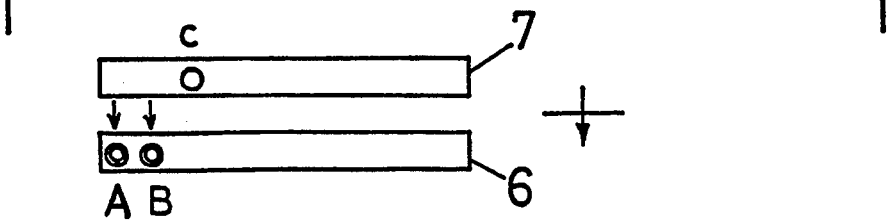

The action at each of the courses will now be explained. As shown in FIG. 2-1, the procedure starts with knitting the front body piece 4 up to the neck portion 2 using the knitting needles A, B, C, D, ... of the front needle bed 6 and the knitting needles a, b, c, d, ... of the rear needle bed 7.

At the end of the front body 4 or the start of the neck portion 2, the loops on the rear knitting needles a to j are transferred and placed over the loops on the front knitting needles A to J as shown in FIG. 2-2. At the course shown in FIG. 2-3, the rear needle bed 7 is moved in a racking procedure 0.5 pitch rightward from the position shown in FIG. 2-2, thus displacing the knitting needles a to j by 0.5 pitch to the right. Then, a thread of yarn is fed onto the two rightend knitting needles I and J of the front needle bed 6 and the knitting needle i of the rear needle bed 7 for forming a loop on each of the needles I, J, and i.

The state shown in FIG. 2-3 is now designated as a reference position.

At the course shown in FIG. 2-4, a loop of yarn is formed on the rear knitting needle i and at the course shown in FIG. 2-5, loops are formed on the two front knitting needles I and J.

Then, the procedure from FIG. 2-4 to FIG. 2-5 is repeated a given number of times as shown in FIGS. 2-6 to 2-7, thus forming a predetermined length of a strand 8 of stitches.

After knitting the strand 8 to the given length, the rear needle bed 7 is moved 1.5 pitches (by racking) to the right as shown in FIG. 2-8 and the loops on the front knitting needles I and J are transferred onto the rear knitting needles g and h respectively.

At the course shown in FIG. 2-10, the rear needle bed 7 is moved 4 pitches leftward from the position shown in FIG. 2-9 or to a position 2.5 pitches leftward distant from the reference position. Then, the loops on the rear knitting needles g and h are transferred onto the front knitting needles E and F as shown in FIG. 2-11. As the result, each of the needles E and F now carries three loops of yarn.

At the course shown in FIG. 2-12, the rear needle bed 7 is further moved by racking one pitch leftward from the position shown in FIG. 2-11 (to a position 3.5 pitches left-ward distant from the reference position). Then, the loop on the rear knitting needle i is transferred onto the front knitting needle F which thus carries four loops, as shown in FIG. 2-13.

As shown in FIG. 2-14, a series of loops are now formed along the front knitting needles E, F, G, and H and simultaneously, the strand 8 developed on the three knitting needles I, J, and i is coupled at one end to the two front knitting needles E and F, thus forming an arch pattern of the stitches.

The rear needle bed 7 is then moved 0.5 pitch back rightward to the reference position from the position shown in FIG. 2-14 and the yarn is fed once again onto the two front knitting needles G and H and the rear knitting needle g for forming a loop on each needle, as shown in FIG. 2-15.

At the courses shown in FIGS. 2-16 to 2-19, the action from FIG. 2-4 to FIG. 2-7 is repeated thus knitting another strand 8 of stitches extending from the knitting needles G and H.

After knitting the other strand 8 of an equal length, the procedure from FIG. 2-8 to FIG. 2-13 is repeated at the courses shown in FIGS. 2-20 to 2-25. As the result, the strand 8 is extended at the front end with three loops hanging on the front knitting needle C and four other loops hanging on the knitting needle D.

At the course shown in FIG. 2-26, another series of loops are formed along the knitting needles C, D, E, and F and the strand 8 developed on the three knitting needles G, H, and g is coupled at the front end to the two front knitting needles C and D, thus forming another arch pattern of the stitches.

As a series of the strands 8 have been knitted along the edge loops of the neck portion 2 of the pullover garment 1, the four leftend knitting needles A, B, C, and D of the front needle bed 6 finally carry a series of loops as shown in FIG. 2-27.

The rear needle bed 7 is then moved 0.5 pitch rightward to return its knitting needles a to J back to the reference position from the position shown in FIG. 2-27 and the yarn is fed onto the two front knitting needles C and D and the rear knitting needle c for forming a loop on each needle, as shown in FIG. 2-28.

At the courses shown in FIGS. 2-29 to 2-32, the action from FIG. 2-16 to FIG. 2-19 is repeated knitting another length of the strand 8 extending from the knitting needles C and D.

After knitting the final strand 8 to an equal length, the rear needle bed 7 is moved one pitch rightward from the position shown in FIG. 2-32 or to a position 1.5 pitches rightward distant from the reference position, as shown in FIG. 2-33. Then, the two loops on the front knitting needles C and D are transferred onto the rear knitting needles a and b respectively at the course shown in FIG. 2-34.

The rear needle bed 7 is now moved by racking 1.5 pitches leftward from the position shown in FIGS. 2-34 or to a position 0.5 pitch leftward distant from the reference position as shown in FIG. 2-35 and at the course shown in FIG. 2-36, the two loops on the rear knitting needles a and b are transferred back onto the front knitting needles A and B, respectively.

At the course shown in FIG. 2-37, the rear needle bed 7 is further moved one pitch leftward from the position shown in FIG. 2-36 or to a position 1.5 pitch distant from the reference position. Then, the loop on the rear knitting needle c is transferred onto the front knitting needle B, as shown in FIG. 2-38. Accordingly, the front knitting needle A carries two loops while the knitting needle B holds three loops. At the course shown in FIG. 2-39, a loop is formed between the two knitting needles A and B. As the result, the number of loops on the four front knitting needles A, B, C, and D shown in FIGS. 2-27 is reduced to a half and a series of arch patterns of the stitches is now produced along the edge of the neck portion 2 of the pullover 1.

The last loop between the two knitting needles A and B is then fastened as shown in FIGS. 3-1 to 3-5.

More specifically, the loop on the front knitting needle B is first transferred onto the rear knitting needle b as shown in FIG. 3-1. Then, the rear needle bed 7 is moved by racking one pitch leftward or to a position 1.5 pitches leftward distant from the reference position at the course shown in FIG. 3-2. The loop on the rear knitting needle b is placed over the loop on the front knitting needle A as shown in FIG. 3-3.

The rear needle bed 7 is now moved 1.5 pitches rightward from the position shown in FIG. 3-3 or to a position 0.5 pitch distant from the reference position as shown in FIGS. 3-4 and 3-5. This action is repeated a given number of times for knitting the loops on the knitting needle A into a last strand of the stitches 8 and fastening the end of a series of the strands 8.

The decorative edge on the neck portion 2 of the pullover garment 1 is now completed in a series of arch patterns, as shown in FIG. 4-A.

For forming a decorative edge of arches shown in FIG. 4-B, the distal end loops of a strand 8 of stitches are hooked on particular knitting needles of the front needle bed 6 which are located far leftward from the proximal end of the strand 8 during the procedures from FIGS. 2-10 to 2-13 and FIGS. 2-22 to 2-25. Then, another strand 8 is started from the succeeding knitting needles of the needle bed 6. The edge region 10 beneath each arch is bound off by an appropriate manner.

Similarly, for forming another decorative edge of arches shown in FIG. 4-C, the distal end loops of a strand 8 of stitches are hooked on particular knitting needles of the front needle bed 6 which are located far leftward from the proximal end of the strand 8 during the procedures from FIGS. 2-10 to 2-13 and FIGS. 2-22 to 2-25. The succeeding strand 8 of arch form Is started from an intermediate between the distal and proximal ends of the first strand 8. The edge region 10 beneath each arch is also bound off by the same manner as of FIG. 4-B.

Also, for forming a further decorative edge of arches shown in FIG. 4-D, two strands of stitches are started from one end of a knitted fabric to be decorated so that the distal end of one strand is coupled to the proximal end of the other. A series of arch patterns are formed by repeating the action of knitting the two strands simultaneously, Although FIG. 4-D exhibits the two strands arranged as a unit, three or more strands will be simultaneously knitted with equal success.

Although the present invention is embodied with the use of a flat knitting machine which has a pair of needle beds arranged opposite to each other, each needle bed carrying a multiplicity of knitting needles, it will be feasible using another knitting machine which has one or more pairs of needle beds.

It is understood that the front needle bed in place of or in addition to the rear needle bed which is movable in the foregoing embodiment, can be arranged for movement.

Although the embodiment provides a decorative finish on the neck piece of a pullover garment, the cuff or other edges will be decorated with equal success.

What is claimed is:

1. A method of finishing an edge of a cuff or neck portion of a knitted fabric formed with a flat knitting machine, said knitting machine having a front needle bed and a rear needle bed, at least one of the needle beds arranged for lengthwise movement, comprising the steps of:

1) transferring loops at an edge of the knitted fabric held by respective knitting needles of one needle bed to the other needle bed,
2) knitting a strand of stitches of a desired length to have a sufficient thickness for functioning as a decorative stitch by using both front and rear needle beds, from a given number of loops carried on knitting needles of the other needle bed,
3) transferring loops of a front end of loops of the strand of loops to the other needle bed,
4) moving the needle beds relative to each other for displacing the front end loops of the strand from a start position of the same,
5) transferring the loops at the end of the strand of loops to knitting needles of one needle bed which are holding loops of an edge of the knitted fabric to provide an arch on the edge of the knitted fabric, said knitting needles of one needle bed to which the loops at an end of the string of loops are transferred are displaced from the knitting needles which are holding the loops at a start of knitting the strand of loops by more than a width of the given number of knitting needles which form the strand of loops,
6) knitting a strand of loops of a desired length by repeating a step of forming loops on the given number of knitting needles between the knitting needles which are holding the loops at the start of knitting the strand of loops and the loops at the end of the strand of loops, and
7) repeating the steps 3–6 to provide a series of arches on the edge of the knitted fabric.

2. A method of finishing an edge of a cuff or neck portion of a knitted fabric formed with a flat knitting machine, said knitting machine having a front needle bed and a rear needle bed, at least one of the needle beds arranged for lengthwise movement, comprising the steps of:

1) transferring loops at an edge of the knitted fabric held by respective knitting needles of one needle bed to the other needle bed,
2) knitting a strand of stitches of a desired length to have a sufficient thickness for functioning as a decorative stitch by using both front and rear needle beds, from a given number of loops carried on knitting needles of the other needle bed, 3) transferring loops of a front end of loops of the strand of loops to the other needle bed,
4) moving the needle beds relative to each other for displacing the front end loops of the strand from a start position of the same,
5) transferring the loops at the end of the strand of loops to knitting needles of one needle bed which are holding loops of an edge of the knitted fabric to provide an arch on the edge of the knitted fabric, such step of transferring loops serving to define a distance between the loops at the start of knitting the strand of loops and the loops at the end of the strand of loops, said distance being greater than a distance along the knitting needle bed consumed by the number of loops which form a strand of loops,
6) knitting a strand of loops of a desired length by repeating a step of forming loops on the given number of knitting needles between the knitting needles which are holding the loops at the start of knitting the strand of loops and the loops at the end of the strand of loops, and
7) repeating the steps 3–6 to provide a series of arches on the edge of the knitted fabric.

3. A method of finishing an edge of a cuff or a neck portion of a knitted fabric formed with a flat knitting machine, said knitting machine having a front needle bed and a rear needle bed, at least one of the needle beds arranged for lengthwise movement, comprising the steps of:

1) transferring loops at an edge of the knitted fabric held by respective knitting needles of one needle bed to the other needle bed,
2) knitting a strand of stitches of loops of a desired length to have a sufficient thickness for functioning as a decorative stitch by using both front and rear needle beds, from a given number of loops carried on knitting needles of the other needle bed,
3) transferring loops of a front end of loops of the strand of loops to the other needle bed,
4) moving the needle beds relative to each other for displacing the front end loops of the strand from a start position of the same,
5) transferring the loops at the end of the strand of loops to knitting needles of one needle bed which are holding loops of an edge of the knitted fabric, and
6) repeating steps 2–5 to provide a series of arches on the edge of the knitted fabric.

* * * * *